US005316021A

United States Patent [19]

Giordano

[11] Patent Number: 5,316,021

[45] Date of Patent: May 31, 1994

[54] HAIR CURLER HAVING LINKING ELEMENT WITH CROSSBAR

[76] Inventor: Giuseppe Giordano, 4, av. des Mousquines, CH-1005 Lausanne, Switzerland

[21] Appl. No.: 836,318

[22] PCT Filed: Jun. 25, 1991

[86] PCT No.: PCT/CH91/00139

§ 371 Date: Feb. 27, 1992

§ 102(e) Date: Feb. 27, 1992

[87] PCT Pub. No.: WO92/00024

PCT Pub. Date: Jan. 9, 1992

[51] Int. Cl.[5] ..... A45D 2/14

[52] U.S. Cl. ..... 132/248; 132/250

[58] Field of Search ..... 132/245, 246, 247, 248, 132/250

[56] References Cited

U.S. PATENT DOCUMENTS

| | | | |
|---|---|---|---|
| 2,099,358 | 11/1937 | Witschi . | |
| 2,865,382 | 12/1958 | Kunze | 132/248 |
| 4,465,085 | 8/1984 | Schopieray | 132/248 |

FOREIGN PATENT DOCUMENTS

| | | | |
|---|---|---|---|
| 843742 | 7/1952 | Fed. Rep. of Germany . | |
| 3828532 | 3/1989 | Fed. Rep. of Germany | 132/248 |
| 9001171 | 7/1990 | Fed. Rep. of Germany . | |

*Primary Examiner*—Cary E. O'Connor
*Assistant Examiner*—Frank A. LaViola

[57] ABSTRACT

The hair curler consists of a body (1) and a linking element (2) for connecting the ends of the hair curler. The linking element (2) is provided with at least one crossbar (11) for preventing the reactive torque of the curled-up hair from pushing the linking element against the roots of the hair.

7 Claims, 1 Drawing Sheet

HAIR CURLER HAVING LINKING ELEMENT WITH CROSSBAR

BACKGROUND OF THE INVENTION

1. Field of the Invention

The subject of this invention is a hair curler consisting of a cylindrical body, circular section or otherwise, the ends of which are joined by a linking element of which at least one end is designed to be removably fastened to the corresponding end of the cylindrical body, the linking element having, in its middle section, a feature designed to counter the reactive torque exercised by the hair rolled onto the curler.

2. Discussion of Prior Art

Traditional hair curlers consist of a cylindrical body and an elastic stretched between the ends of the cylindrical body to hold the hair rolled onto the hair curler. When applying such a hair curler, the elastic is generally stretched along the side of the hair curler opposite the scalp. The hair rolled onto the hair curler exercises on the latter a reactive torque which tends to make the hair curler turn until the elastic rests against the lock of hair, near to the roots of the hair. The effect of this is, on the one hand the loosening of the hair which is being rolled hair and, on the other hand, to exercise, through the elastic, a permanent pressure on the roots of the hair. There is a risk therefore of breaking brittle hair. Moreover, with the elastic in this position, the hair curler exercises an uncomfortable traction on the hair.

It is well-known that this fault can be remedied by using a semi-rigid rod under the elastic of several hair curlers. The application of such a rod under the elastic is a tedious operation. It is, moreover, difficult to do without pulling on the hair.

To dispense with such a bar, it has already been suggested to use hair curlers the elastic of which has a small side flap in its middle section; a small flap which has at its end a hook designed to hook onto the elastic of the next-hair curler (DE-38 28 532). In this case, it is still necessary to pass the small flap under the elastic of the next hair curler and, consequently, to lift the elastic of this next hair curler.

SUMMARY OF THE INVENTION

This invention aims to design a hair curler which avoids both the disadvantages of standard hair curlers but which does not require any particular additional handling.

The hair curler of this invention is characterised by the fact that the feature designed to counter the reactive torque exercised by the hair rolled onto he hair curler consists of at least one lateral projection.

The hair curler preferably has at least two opposite lateral projections so that the hair curler can equally be placed in any direction.

These lateral projections may consist of a crossbar which forms a cross with the linking element. This crossbar can be made in one piece with the linking element. The length of this bar is such that, under the effect of the reaction of the hair the bar will place itself approximately perpendicular to the head by resting on the latter by one of its ends. The bar is preferably made of flexible material so as not to cause uncomfortable pressure on the head. The linking element can be flexible or otherwise.

Unrolling of the hair curler after the linking element is fastened is negligible in particular if the linking element is placed directly laterally on the hair curler.

BRIEF DESCRIPTION OF THE DRAWINGS

The appended sketch shows, by way of example, one way of using the invention.

DETAILED DESCRIPTION OF PREFERRED EMBODIMENTS

Figure 1:
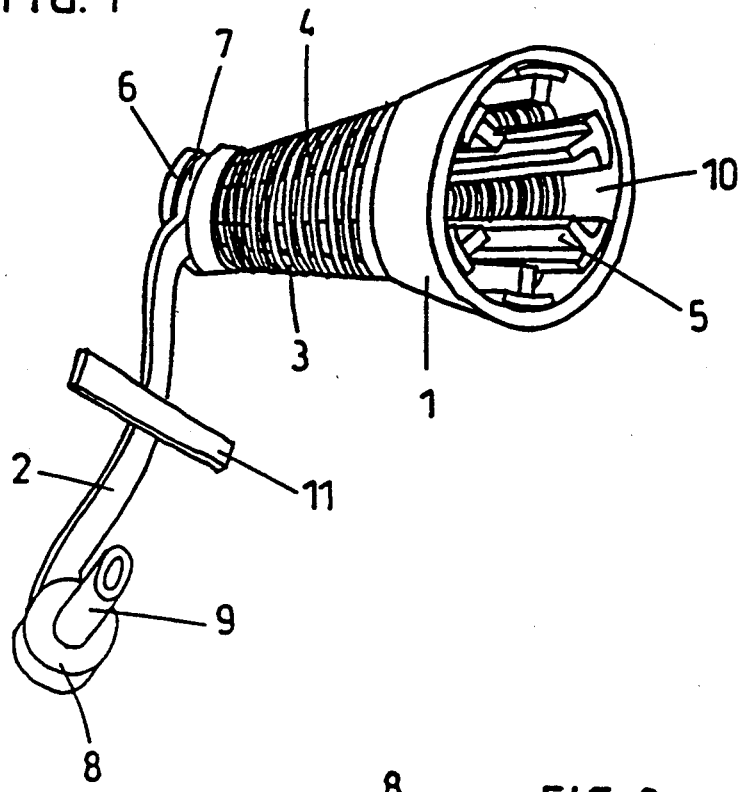
FIG. 1 is a perspective of a hair curler.

The hair curler shown in FIG. 1 consists, on the one hand, of a tubular, cylindrical body 1 and, on the other hand, of a flexible linking element 2. The body 1 has circular, external grooves 3 along most of its length. In these grooves, a certain number of holes 4 are cut. Inside, the tubular hair curler is reinforced by longitudinal ribs 5. The end 6 of the hair curler has a groove in which one of the ends of the flexible linking element 2 is fastened with an eyelet 7; the other end of the flexible linking element 2 consists of a disc 8 with a tubular, cylindrical projection 9 designed to be inserted in an axis fashion in the end 10 of the body 1, between the ribs 5. The flexible linking element 2 also has, in its middle section, a crossbar 11 made of a flexible material such as rubber. This bar forms a projection of around 1 cm from either side of the elastic linking element 2.

Figure 2:
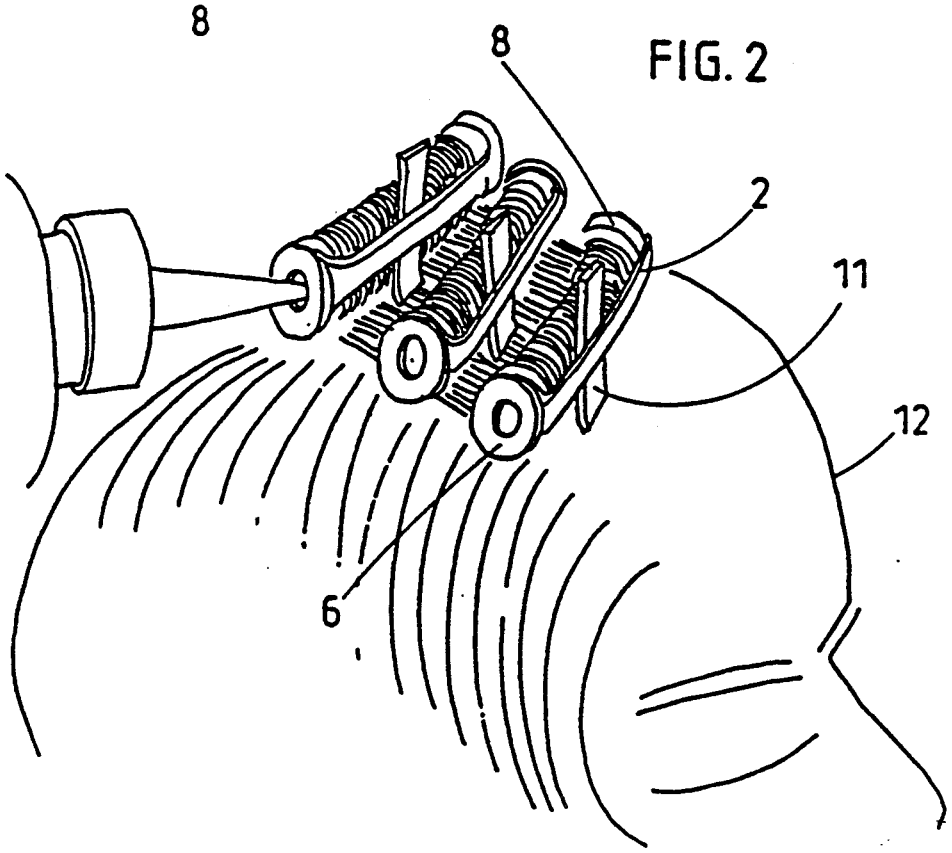
FIG. 2 illustrates the use of the hair curler according to FIG. 1.

FIG. 2 illustrates the effect of the crossbar 11. The hair curlers are used in the conventional way : The hair is rolled onto the hair curler, then the flexible linking element is stretched between the two ends of the hair curler. The crossbar 11 positions itself automatically in an approximately perpendicular position to the head 12 by resting, by resting, by one of its ends, on the head, thus preventing the hair curler from unrolling and the flexible linking element 2 from exerting a pressure on the roots of the hair.

Given the symmetry of the crossbar 11, the hair curler can be equally unrolled from either side.

In place of a bar 11 in rectangular shape, one could, of course, use a part with a different shape, the important thing being to have a projection from each side of the flexible linking element 2.

In order to distribute the pressure, it would be possible to have two or three crossbars or similar pieces.

The linking element 2 could be non-flexible and the body 1 flexible.

The projection or projection(s) 11 could be non-flexible.

I claim:

1. A hair curler around which hair is temporarily wound so as to impart a curl to said hair, said hair, when wound around said curler, generating an unwinding torque tending to unwind said curler, said curler comprising:

an elongate body portion, having two ends, around which hair to be curled is wound; and a transverse linking element means, fixably fastened at one of said two ends of said elongated body portoin and removably fastened to the other of said two ends of said elongate body portion, for retaining hair in place on said elongate body portion when said hair is wound on said elongate body portion, said transverse linking element including means, independent of any other curler, for countering said unwinding torque, said torque countering means comprising at least one lateral projection extending from said transverse linking element.

2. A hair curler according to claim 1, wherein said at least one lateral projection is located substantially midway between said two end of said elongate body portion.

3. A hair curler according to claim 1, wherein said elongate body portion is hollow.

4. A hair curler according to claim 1, wherein said at least one lateral projection comprises two axially aligned projections, each of said axially aligned projection extends in opposite directions from said transverse linking element.

5. A hair curler according to claim 1, wherein said hair curler has a curler radius of curvature around which said hair, growing from a skin surface, is wound, said torque countering means including means for preventing said hair from being deformed about a radius of curvature less than said curler radius of curvature.

6. A hair curler according to claim 5, wherein said at least one lateral projection extends from said linking element in a direction towards the skin surface.

7. A hair curler according to claim 5, wherein said at least one lateral projection comprises two aligned lateral projections forming a bar crossing said linking element means and one of said lateral projections extends toward the skin surface.

* * * * *